United States Patent [19]

Schellenberg et al.

[11] Patent Number: 4,835,496

[45] Date of Patent: May 30, 1989

[54] POWER DIVIDER/COMBINER CIRCUIT

[75] Inventors: James M. Schellenberg, Huntington Beach; Wing Yau, Torrance, both of Calif.

[73] Assignee: Hughes Aircraft Company, Los Angeles, Calif.

[21] Appl. No.: 227,474

[22] Filed: Aug. 1, 1988

Related U.S. Application Data

[63] Continuation of Ser. No. 868,211, May 28, 1986, abandoned.

[51] Int. Cl.[4] ..... H01P 3/08; H01P 5/12

[52] U.S. Cl. ..... 333/128; 333/125; 333/246; 330/286

[58] Field of Search ..... 333/128, 125, 136, 238, 333/246, 124; 330/286, 53

[56] References Cited

U.S. PATENT DOCUMENTS

| | | | |
|---|---|---|---|
| 3,886,498 | 5/1975 | Mosko et al. | 333/128 |
| 3,963,993 | 6/1976 | Hoffman et al. | 330/286 X |
| 4,129,839 | 12/1978 | Galani et al. | 333/128 |
| 4,386,324 | 5/1983 | Schellenberg | 333/128 X |
| 4,490,695 | 12/1984 | de Ronde | 333/128 |

FOREIGN PATENT DOCUMENTS

| | | | |
|---|---|---|---|
| 1528743 | 5/1968 | France . | |
| 53-49930 | 5/1978 | Japan . | |
| 0247303 | 12/1985 | Japan | 333/128 |

OTHER PUBLICATIONS

Schellenberg et al, "A Wideband Radial Power Combiner for FET Amplifiers", 1978 IEEE ISSCC Digest, Feb. 1978, pp. 164–165.

Wilkinson, "An N-Way Hybrid Power Divider", IRE Trans. on Microwave Theory and Techniques, MTT-8, No. 1, Jan. 1960, pp. 116–119.

Nagai et al, "New N-Way Hybrid Power Dividers", IEEE Trans. on Microwave Theory & Tech. vol. MTT-25, No. 12, Dec. 1977, pp. 1008–1012.

Itoh et al, "A Generalized Spectral . . . Tuning Septums", IEEE Trans. on Microwave Theory and Tech. vol. MTT-26, No. 10, Oct. 1978, pp. 820–826.

Smith, "The Even and Odd Mode . . . Suspended Substrate", IEEE Trans. on Microwave Theory & Tech. vol. MTT-19, No. 5, May 1971, pp. 424–431.

Klopfenstein, "A Transmission Line Taper of Improved Design", Proceedings of the IRE, Jan. 1956, pp. 31–35.

Adel A. M. Saleh, "Planar Electrically Symmetric n-Way Hybrid Power Dividers/Combiners", IEEE Transactions on Microwave Theory and Techniques, vol. MTT-28, No. 6, Jun. 1980, pp. 555–563.

H. J. Reich et al., "Microwave Theory and Techniques", D. Van Nostrand Co., Inc., New York, pp. 101–104.

Proceedings of the 12th European Microwave Conference, Sep. 13–17, 1982, Helsinki, FL, Microwave Exhibitions, Ltd. (Tunbridge Wells, Kent GB), F. C. de Ronde: "A Multi-Octave Matched Quarterwave Microstrip Taper", pp. 617–621.

*Primary Examiner*—Eugene R. LaRoche
*Assistant Examiner*—Seung Ham
*Attorney, Agent, or Firm*—Terje Gudmestad; A. W. Karambelas

[57] ABSTRACT

Disclosed herein is an N-way, broad band planar power divider/combiner circuit for dividing or combining RF signals which includes a tapered strip of electrically conductive material having a plurality of conductor fingers which define a plurality of ports at the wide end of the taper, and having a narrow end which defines single port. The tapered metal strip is mounted onto a dielectric slab, and isolation resistors connect adjacent fingers. A single RF signal can be fed into the single port which will be divided into a plurality of signals of equi-amplitude and equi-phase. Conversely, a plurality of RF signals can be fed into the ports at the wide end which will be combined into a single signal.

16 Claims, 2 Drawing Sheets

Fig. 1a.
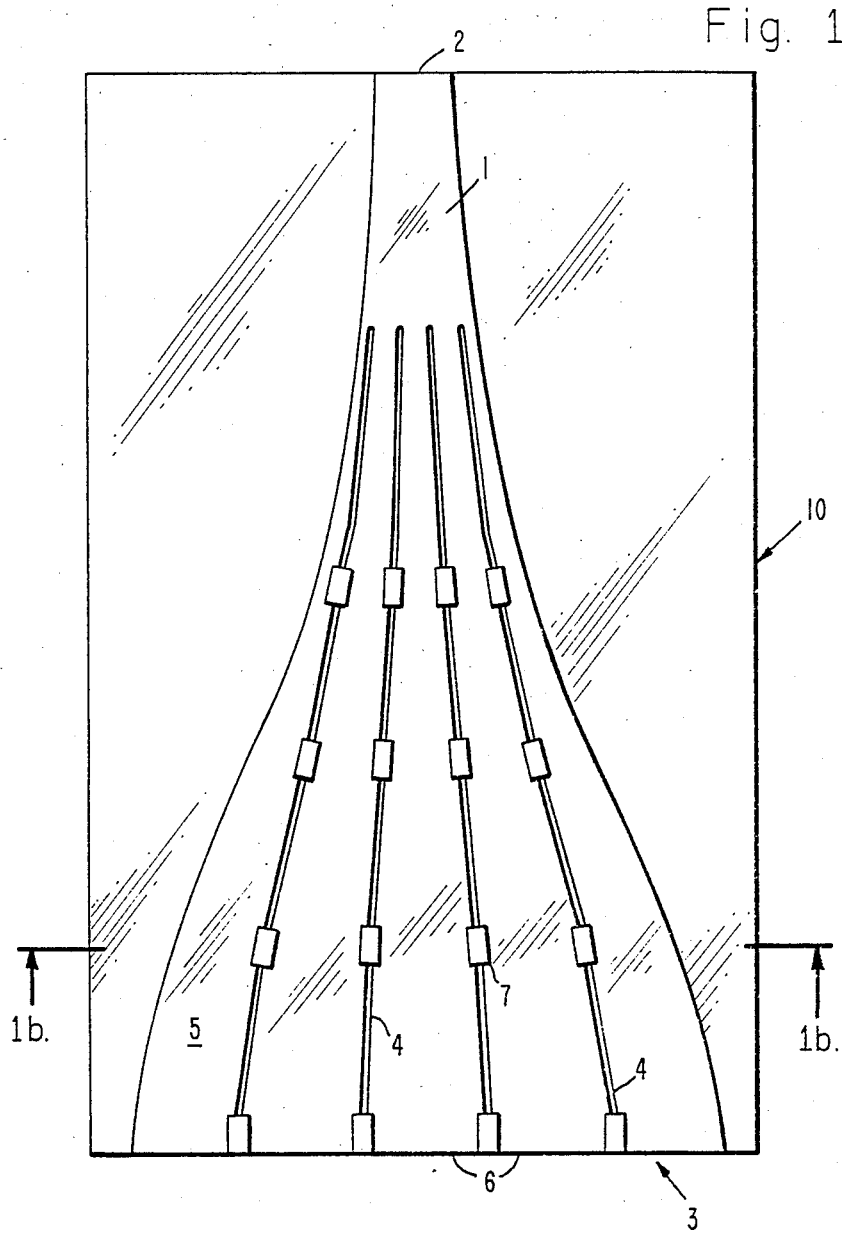
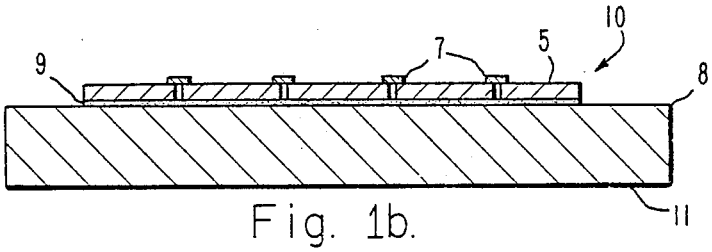
Fig. 1b.

POWER DIVIDER/COMBINER CIRCUIT

This application is a continuation of application Ser. No. 868,211, filed May 28, 1986, now abandoned.

BACKGROUND OF THE INVENTION

1. Field of the Invention

This invention relates to microwave and millimeter wave integrated circuits and more particularly to a planar power divider/combiner circuit which may be used to divide an RF signal into a plurality of signals or combine a plurality of RF signal sources into a single signal.

As used throughout this specification and the claims, the term RF signal includes both microwave and millimeter wave signals.

2. Description of the Related Art

Power divider circuits have been developed to divide RF signals into a number of signals to feed multi-element antennas. Conversely, power combiner circuits were developed to combine the output of a number of solid state amplifiers, chip transistors or oscillators. Several different circuit geometries have evolved to accomplish this power dividing or combining such as: The circular-geometry Wilkinson power divider disclosed in G. J. Wilkinson, "An-N Way Hybrid Power Divider," *IRE Trans. on Microwave Theory and Tech.*, MTT-8 No. 1, pp. 116–19 (January 1960); the fork power divider disclosed in an article by A. Saleh entitled "Planar, Electrically Symmetric N-Way Hybrid Power Dividers/Combiners," *IEEE Trans. Microwave Theory Tech.*, MTT-28, No. 6, pp. 555–63 (June 1980); and the radial power divider disclosed in an article authored by J. Schellenberg & M. Cohn, "A Wideband Radial Power Combiner for FET Amplifiers," 1978 *IEEE ISSCC Digest* 164–165, 273 (February 1978). None of these power divider/combiner circuits, however, can provide phase matching, ultra-wide bandwidth, impedance transforming, port to port isolation in a planar compact power dividing and combining circuit all at the same time.

SUMMARY OF THE INVENTION

Accordingly, it is therefore an object of the present invention to provide a compact planar integrated circuit for both dividing and combining microwave and millimeter signals.

It is yet another object of the present invention to provide a power divider/combiner circuit that achieves greater than a 100% bandwidth.

It is still a further object of the present invention to provide a power divider/combiner circuit which divides a single signal source into a plurality of equi-phase, equi-amplitude signals over a broad frequency range.

It is still a further object of the present invention to provide a power divider/combiner circuit which provides phase matching at each port to ensure efficient power combining.

It is yet another object of the present invention to provide a power divider/combiner circuit that combines a plurality of RF signals sources efficiently into one RF signal of magnitude equal to the sum of all the signal sources.

It is still a further object of the present invention to provide a power divider/combiner circuit that provides good port-to-port isolation.

It is still a further object of the present invention to provide a power divider/combiner circuit that provides impedance transforming and power combining or dividing at the same time.

A power divider/combiner circuit according to the invention comprises a flat tapered strip of electrically conductive material with a plurality of slots therein extending from the wide end of the tapered strip toward the narrow end of the strip such that the strip defines a plurality of fingers. The narrow end of the tapered strip forms one port, either an input or an output port, and the respective tips of the fingers form a plurality of ports which can be either input ports or output ports. Isolation resistors connect adjacent fingers at quarter wavelength distances along the fingers. The tapered strip is mounted on a dielectric substrate.

An input signal from an RF signal source may be fed into the single port at the narrow end of the tapered strip. The input signal will be divided into a plurality of RF signals of equi-amplitude and equal phase at the finger ports. Conversely, when a plurality of RF input signals are fed into the finger ports, these signals will combine into a single RF signal at the single port at the narrow end of the tapered strip.

Additional objects, advantages and characteristic features of the invention will become readily apparent from the following detailed description of a preferred embodiment of the invention when considered in conjunction with the accompanying drawings.

BRIEF DESCRIPTION OF THE DRAWINGS

FIG. 1*a* is a top plan view of a power divider/combiner circuit according to the principles of the present invention;

FIG. 1*b* is a cross-sectional view taken along line 1*b*–1*b* of FIG. 1*a.

DESCRIPTION OF THE PREFERRED EMBODIMENT

Figure 2:
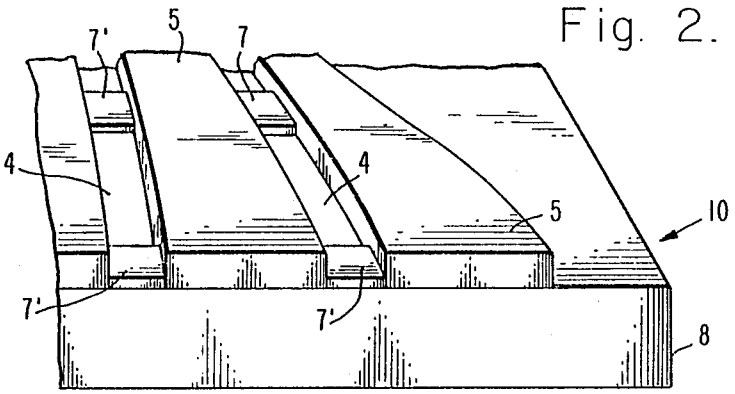
* and FIG. 2 is an enlarged perspective view partly broken away, illustrating a portion of a power divider/combiner circuit according to another embodiment of the invention.

Referring to FIGS. 1*a* and 1*b* with greater particularly, a power divider/combiner circuit 10 according to the invention may include a tapered strip of electrically conductive material 1 with a narrow end 2 and a wide end 3. The tapered strip 1 is preferably made of a metal such as gold, but may be made of any other good electrically conductive material. The strip may be about 2–3 skin depths thick for the lower frequency of the desired bandwidth of operation. The tapered strip 1 provides a tapered transmission line in which the contour of the taper is selected to match the impedance at the narrow end 2 of the tapered strip to the impedance at the wide end 3 of the tapered strip over the desired bandwidth of operation. The contour and lengths of the taper determine the maximum inband reflection coefficient and the lower cut off frequency, respectively.

While many taper geometrices are available, such as an exponential taper or a hyperbolic taper, a Dolph-Tchebycheff taper has been found to afford optimum performance because it provides a minimum length for the transmission line for a specified maximum magnitude reflection coefficient in the passband. The design equations for the Dolph-Tchebycheff taper may be found in an article authored by R. W. Klopfenstein entitled "A Transmission Line Taper of Improved Design," 44 *Proc. IRE* pp. 31–35 (January 1956), which is incorporated herein by reference.

The tapered strip 1 has a plurality of slots 4 therein extending from the wide end 3 of the strip toward the narrow end 2 of the strip which define a plurality of conductor fingers 5. The narrow end 2 of the tapered strip 1 thus defines a single port 2 which can be either an input port or an output port depending on whether the circuit is used as a power divider or combiner, respectively. The tips of the conductor fingers 5 at the wide end 3 of the strip 1 define N ports 6, where N is an integer greater than 1, which can be either output ports or input ports depending on whether the circuit is used as a power combiner or divider, respectively. Although 5 ports are shown FIGS. 1*a* and 1*b*, any number of ports are possible. The slot width, i.e. the spacing between the adjacent fingers 5, should be kept small to enhance coupling between adjacent fingers and thus ensure that the structure retains the characteristics of a Dolph/Tchebycheff tapered transmission line. A slot width of about 1.5 mil has been typically used.

The fingers 5 function as strip line conductors. Several methods are available for determining the appropriate widths (even mode impedance) and gap spacings for strip line conductors, such as disclosed in J. I. Smith, "The Even and Odd Mode Capacitance Parameters for Coupled Lines in Suspended Substrate," *IEEE Trans. Microwave Theory Tech.*, Vol. MTT-19, pp. 424–31 (May 1971) or T. Itoh & A. S. Herbert, "A Generalized Spectrum Domain Analysis for Coupled Suspended Microstriplines with Tuning Septums," IEEE Trans Microwave Theory Tech. Vol. MTT-26, pp. 820–27, (October 1978), which are incorporated herein by reference.

The methods described in the aforementioned publications are designed to determine widths and gap spacing for strip conductors of uniform width. Since the conductor strip fingers 5 of the present invention are tapered, the equations for determining the widths of uniform width strip line conductors disclosed in these publications should be reiteratively applied to determine the width of each finger strip at a sufficient number of points along the strip to define the appropriate taper.

Isolation resistors 7 connect adjacent conductor fingers 5. The resistors 7 absorb signals that are reflected back into the power divider/combiner circuit, the odd mode propagation. These resistors may be chip resistors 7 disposed on top of the strip as illustrated in FIG. 1, or thick or thin film resistors 7' located between the fingers 5 in the slots 4 on the substrate 8, as illustrated in FIG. 2.

The number of isolation resistors 7 disposed along each pair of adjacent fingers 5 should preferably be one less than the total number of finger ports in the circuit to effectively absorb the propagation of odd modes. Thus in the exemplary embodiment shown in FIGS. 1*a* and 1*b*, where 5 ports are used there are 4 resistors along each pair of adjacent fingers. However, additional or fewer resistors also may be employed.

Several methods are available for determining the resistance value for the isolation resistors 7. First the "variational method" or the "spectral domain method" disclosed in the Smith or Itoh & Herbert articles referred to above accurately provide the odd mode impedance needed to calculate the resistance of the isolation resistors 7. Then resistance values can be determined using the method disclosed in N. Nagai, E. Matkawa, and K. Ono, "New N-Way Hybrid Power Dividers," *IEEE Trans. Microwave Theory Tech.*, Vol. MTT-25, No. 12, pp. 1008–1012 (December 1977), which is incorporated herein by reference.

The tapered strip 1 may be adhesively mounted onto a dielectric substrate 8 which is generally a thin flat plate of dielectric material. The substrate for example, may be made of sapphire, beryllium oxide, quartz, or alumina. The adhesive material 9 may be chrome or ti-tungsten or any other good conductive adhesive material. In operation, the dielectric substrate may be grounded at the bottom surface 11 of the substrate 8.

Figure 3:
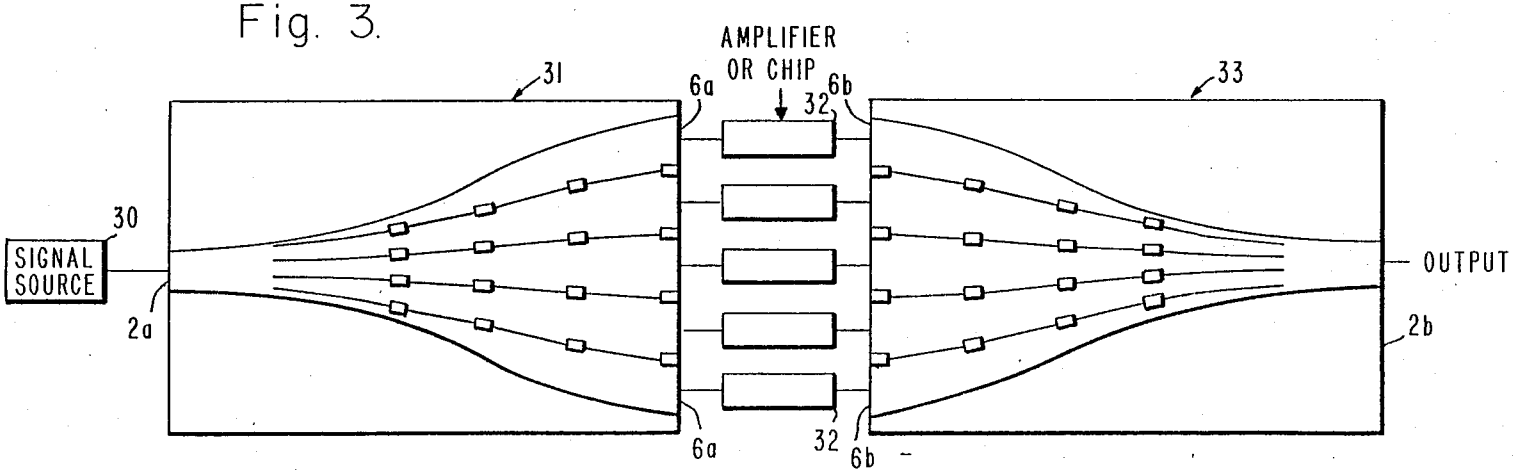
FIG. 3 is a top plan view illustrating still another embodiment of the invention using a pair of power divider/combiner circuits. It will be appreciated that FIGS. 1–3 are not drawn to scale.

FIG. 3 illustrates a power divider/combiner circuit according to a further embodiment of the present invention. The circuit of FIG. 3 includes an RF signal source 30 which may be an oscillator or amplifier, for example. The signal from the source 30 is fed into the single port 2*a* of a power divider/combiner circuit 31. This single RF signal is divided into a plurality of RF signals at the finger ports 6*a*. These signals are amplified by respective amplifiers 32 which may be hybrid amplifiers prematched chips, microwave monolithic integrated circuit chips, transistor chips, for example, and fed into respective finger ports 6*b* of power divider/combiner circuit 33 according to the invention which, in turn, combines these N amplified RF signals into a single RF signal at port 2*b*. The resultant output signal is the summation of the various output signals from the amplifiers 32.

It should be understood that although the invention has been shown and described for one particular embodiment, nevertheless various charges and modifications obvious to a person skilled in the art to while the invention pertains are deemed to live within the spirit and scope of the invention as set forth in the appended claims.

What is claimed is:

1. A broadband power divider/combiner circuit which comprises:

a dielectric substrate;

a tapered strip of electrically conductive material mounted on said substrate, said strip having a wide end tapering to a narrow end in a Dolph-Tchebycheff taper, said tapered strip further having a plurality of slots therein of constant widths defining a plurality of fingers the respective widths of which taper from wide at the wide end of said strip to narrow at the narrow end of said strip in a Dolph-Tchebycheff taper, adjacent ones of said fingers being sufficiently closely spaced to provide efficient coupling therebetween; and resistive means electrically connecting adjacent ones of said fingers.

2. A power divider/combiner circuit as defined in claim 1 further comprising means for applying an input signal to the narrow end of said tapered strip.

3. A power divider/combiner circuit as defined in claim 1 further comprising means for applying a plurality of input signals to said fingers at said wide end of said tapered strip.

4. A power divider/combiner circuit as defined in claim 1 wherein said resistive means comprises a plurality of resistors electrically connecting adjacent ones of said fingers at quarter wavelength distances along the fingers for signals selectively applied to either said narrow end, or the ends of respective fingers at said wide end.

5. A power divider/combiner as defined in claim 4 wherein said resistors are chip resistors disposed on top of said strip overlapping adjacent portions of adjacent ones of said fingers.

6. A power divider/combiner as defined in claim 4 wherein said resistors are thick film resistors which are located on said substrate between adjacent ones of said fingers in said slots and which are making electrical contact to adjacent portions of adjacent ones of said fingers.

7. A power divider/combiner as defined in claim 4 wherein said resistors are thin film resistors which are located on said substrate between adjacent ones of said fingers in said slots and which are making electrical contact to adjacent portions of adjacent ones of said fingers.

8. A power divider/combiner as defined in claim 1 wherein said dielectric substrate is of a material selected from the group consisting of sapphire, beryllium oxide, quartz and alumina.

9. A power divider/combiner circuit as defined in claim 1 wherein said power divider/combiner circuit has a predetermined lower cutoff frequency and said tapered strip of metal is about three skin depths thick for said predetermined lower cutoff frequency.

10. A power divider/combiner circuit as defined in claim 1 wherein the spacings between adjacent ones of said fingers are about 1.5 mils.

11. A broadband power divider circuit for dividing millimeter wave or microwave signals, which comprises:

a dielectric substrate;

a tapered strip of electrically conductive material mounted on said substrate, said strip having a wide end tapering to a narrow end in a Dolph-Tchebycheff taper and a plurality of slots therein of constant width extending along the length of said tapered strip from the wide end to the narrow end defining a plurality of fingers the respective widths of which taper from wide to narrow in a Dolph-Tchebycheff taper, adjacent ones of said fingers being sufficiently closely spaced to provide efficient coupling therebetween;

resistive means electrically connecting adjacent ones of said fingers; and means for applying a signal to the narrow end of said tapered strip.

12. A broadband power combiner circuit for combining millimeter wave or microwave signals, which comprises:

a dielectric substrate;

a tapered strip of electrically conductive material mounted on said substrate, said strip having a wide end tapering to a narrow end in a Dolph-Tchebycheff taper and a plurality of slots therein of constant width extending along the length of said tapered strip from the wide end to the narrow end defining a plurality of fingers the respective widths of which taper from wide to narrow in a Dolph-Tchebycheff taper, adjacent ones of said fingers being closely spaced to provide efficient coupling therebetween;

resistive means electrically connecting adjacent ones of said fingers; and means for applying a plurality of signals into said fingers at the wide end of said tapered strip.

13. A broadband power divider/combiner circuit which comprises:

a first dielectric substrate;

a first tapered strip of electrically conductive material mounted on said substrate, said strip tapering from a wide end to a narrow end in a Dolph-Tchebycheff taper, said first tapered strip further having a plurality of slots therein of constant widths extending along the length of said tapered strip from the wide end to the narrow end defining a plurality of first fingers the respective widths of which taper from wide to narrow in a Dolph-Tchebycheff taper, adjacent ones of said fingers being sufficiently closely spaced to provide efficient coupling therebetween;

first resistive means electrically connecting adjacent ones of said first fingers;

means for applying a first signal to the narrow end of said first tapered strip;

a second dielectric substrate;

a second tapered strip of electrically conductive material mounted on said second substrate, said second strip tapering from a wide end to a narrow end in a Dolph-Tchebycheff taper, said second tapered strip further having a plurality of slots therein of constant widths extending along the length of said second tapered strip from the wide end to the narrow end defining a plurality of second fingers the respective widths of which taper from wide to narrow in a Dolph-Tchebycheff taper, adjacent ones of said fingers being efficiently closely spaced to provide efficient coupling therebetween;

second resistive means electrically connecting adjacent ones of said second fingers; and signal translating means electrically connected between respective corresponding pairs of said first and second fingers.

14. A power divider/combiner circuit as defined in claim 13 wherein said translating means comprises a plurality of amplifiers.

15. A broadband power divider/combiner circuit which comprises:

a dielectric substrate;

a tapered strip of electrically conductive material mounted on said substrate, said strip having a wide end tapering to a narrow end in a hyperbolic taper, said tapered strip further having a plurality of slots of constant widths therein defining a plurality of fingers the respective widths of which taper from wide at the wide end of said strip to narrow at the narrow end of said strip in a hyperbolic taper, adjacent ones of said fingers being sufficiently closely spaced to provide efficient coupling therebetween; and resistive means electrically connecting adjacent ones of said fingers.

16. A broadband power divider/combiner circuit which comprises:

a dielectric substrate;

a tapered strip of electrically conductive material mounted on said substrate, said strip having a wide end tapering to a narrow end in an exponential taper, said tapered strip further having a plurality of slots therein of constant widths defining a plurality of fingers the respective widths of which taper from wide at the wide end of said strip to narrow at the narrow end of said strip in an exponential taper adjacent ones of said fingers being sufficiently closely spaced to provide efficient coupling therebetween; and resistive means electrically connecting adjacent ones of said fingers.

* * * * *